US005784768A

United States Patent [19]

Rojdev

[11] Patent Number: 5,784,768

[45] Date of Patent: Jul. 28, 1998

[54] CASKET HAVING QUICKLY INTERCHANGEABLE AND ADJUSTABLE INTERIOR

[75] Inventor: Ilija Rojdev, Fairfield, Ohio

[73] Assignee: Batesville Casket Company, Inc., Batesville, Ind.

[21] Appl. No.: 406,510

[22] Filed: Mar. 20, 1995

[51] Int. Cl.[6] ..... A61G 17/00

[52] U.S. Cl. ..... 27/19; 27/17; 27/35; 27/DIG. 1; 24/576; 24/587

[58] Field of Search ..... 27/19, 17, 35, 27/DIG. 1; 24/587, 576

[56] References Cited

U.S. PATENT DOCUMENTS

| | | |
|---|---|---|
| 2,622,250 | 1/1952 | Coles . |
| 2,848,782 | 8/1958 | Gillison . |
| 3,218,688 | 11/1965 | Slaughter . |
| 3,233,302 | 2/1966 | Ross . |
| 3,246,379 | 4/1966 | Slaughter et al. . |
| 4,003,109 | 1/1977 | Matichak . |
| 4,312,104 | 1/1982 | Baker et al. . |

*Primary Examiner*—Christopher Kent
*Attorney, Agent, or Firm*—Wood, Herron & Evans, L.L.P

[57] ABSTRACT

A casket having a quickly interchangeable and adjustable interior comprises a casket shell, an elongated fastening device having first and second portions, the first portion being secured to the casket shell, and decorative fabric secured to the second portion of the fastening device. One of the first and second fastening device portions includes a longitudinally continuous female fastening element and the other of the first and second fastening device portions includes a longitudinally continuous male fastening element receivable in the female fastening element. The male and female fastening elements are relatively slideably moveable longitudinally when engaged and are fabricated from resilient material. The fastening device allows quick installation and removal of the decorative fabric by resilient engagement of the fastening elements and provides longitudinal adjustment of the decorative fabric relative to the casket shell by slideably moving the fastening elements longitudinally relative one another.

43 Claims, 2 Drawing Sheets

CASKET HAVING QUICKLY INTERCHANGEABLE AND ADJUSTABLE INTERIOR

FIELD OF THE INVENTION

This invention relates generally to burial caskets, and more particularly to a casket having a quickly interchangeable and adjustable interior.

BACKGROUND OF THE INVENTION

Burial caskets have been traditionally outfitted with decorative interiors. These interiors have traditionally taken the form of a decorative cap panel and peripheral puffing mounted in the underside of the casket cap, a pillow and shirred or other decorative fabric lining the interior side walls of the casket shell. In addition, the side wall of the casket shell opposite the hinge connection of the cap to the shell traditionally carries an additional, larger, piece of shirred or other decorative fabric for overlaying the top edge of the casket shell during periods when the casket cap is opened for presentation and viewing of the deceased. The smaller decorative fabric portions which line the interior side walls of the casket shell are each known as a "small body", whereas the larger piece of decorative fabric which is placed over the casket shell edge during presentation and viewing is known as the "big body". In addition to these decorative pieces of fabric, the interior of the casket shell may also be outfitted with a sheet of polyester or other batting material or padding intermediate the casket shell wall and the small body in order to provide firmness, fullness, etc., to the small body.

In traditional wooden casket constructions, each of these decorative fabric portions, as well as the batting, is normally simply stapled to either the interior surface or the top edge of the casket shell side wall. Thus, once outfitted with a particular decorative interior, the casket cannot have its interior quickly removed and another, different decorative interior installed should a customer desire to view such differing interiors in the casket. In addition to being laborious and time consuming, such removal of the decorative interiors would damage the interiors thus precluding their further use.

Metal caskets are subject to many of the same criticisms. In a traditional metal casket construction, the casket shell includes a channel formed therein and in which is inserted a cardboard or wooden insert. The big body, small body and batting or padding are simply stapled to the cardboard or wooden insert. Thus, as with wooden caskets, once installed in a metal casket, the interior is not readily removed and interchanged with a different style of interior.

Attempts to provide for a quickly interchangeable interior for a casket have not met with complete success. Various fastening means have been proposed for removably attaching the decorative fabric and/or batting or padding to the casket shell, which fastening means promote prompt and rapid detachment and removal of the interior. Examples of such fastening means include, for example, buttons and snaps. However, both of these types of fastening means are subject to breakage and failure, and furthermore, since the decorative fabric is only supported at discrete points along the length of its edge to the casket shell wall, the decorative fabric tends to sag between the buttons and snaps thus creating an unsightly appearance.

Other fastening means which may be continuous in length and thus eliminating the sagging problem, have taken the form of zippers and hook and loop fastening strips. The drawback with these types of fastening means, however, is that the decorative fabric and/or batting or padding can become misaligned longitudinally within the casket during installation but these fastening means allow for little or no easy longitudinal adjustment of the decorative fabric relative to the interior of the casket shell once installed. In addition, the zippers and hook and loop fasteners can be slow to engage and can create unwanted noise disturbances during presentation of the casket interior to the grieving family of the deceased.

It is therefore an objective of the present invention to provide an interior for a casket which is quickly installed and removed, yet which does not sag between discrete points of attachment of the interior to the casket shell wall.

It is another objective of the present invention to provide an interior for a casket which is easily adjustable longitudinally relative to the casket shell in order to remedy any longitudinal misalignment of the interior relative to the casket shell which may have arisen during installation thereof.

It is yet another objective of the present invention to provide an interior for a casket which does not create unwanted noise disturbances during installation into and removal from the casket shell.

SUMMARY OF THE INVENTION

The present invention attains the stated objectives by providing a casket having a quickly interchangeable and adjustable interior. The casket comprises a casket shell, an elongated fastening device having first and section portions, the first portion being secured to the casket shell, and decorative fabric and/or padding secured to the second portion of the fastening device. One of the first and second fastening device portions includes a longitudinally continuous female fastening element. The other of the first and second fastening device portions includes a longitudinally continuous male fastening element receivable in the female fastening element. The male and female fastening elements are relatively slideably moveable longitudinally when the fastening elements are engaged. The fastening device allows quick installation and removable of the decorative fabric and/or padding in the casket shell by engagement of the male and female fastening elements and provides longitudinal adjustment of the decorative fabric and/or padding relative to the casket shell by moving the fastening elements longitudinally relative one another.

In one form, the female fastening element is a longitudinally continuous channel and the male fastening element is a longitudinally continuous wall receivable in the channel. The longitudinally continuous channel includes a pair of side walls interconnected by a web wall. One side wall of the pair of side walls includes a lip on a free edge thereof projecting toward the other side wall of the pair of side walls. The longitudinally continuous wall includes a lip on a free edge thereof projecting toward the longitudinally continuous channel lip. The longitudinally continuous wall lip resides between the longitudinally continuous channel web wall and lip when the first and second fastening portions are engaged.

The first and second fastening device portions are preferably fabricated from resilient material, for example low density polyethylene, the flexibility and resiliency of which provides for easy and secure engagement of the fastening device portions as the channel, wall and lips may deflect to allow the lips to pass by one another and then resiliently spring back to their original undeflected state to lock each other.

In a preferred form, the first and second fastening portions both comprise a longitudinally continuous channel having a pair of side walls interconnected by a web wall. One side wall of the pair of side walls of each of the channels is receivable between the pair of side walls of the other of the channels. One side wall of each of the pairs of side walls includes a lip on a free edge thereof. The lips project toward one another. Each lip resides between the other lip and a respective web wall when the first and second fastening portions are engaged.

One advantage of the present invention is that a quickly interchangeable and adjustable interior for a casket is provided which does not sag between discrete attachment points of the interior to the casket.

Another advantage of the present invention is that a quickly interchangeable and adjustable interior for a casket is provided which provides for easy longitudinal adjustment of the interior relative to the casket shell to alleviate any misalignment thereof.

Yet another advantage of the present invention is that a quickly interchangeable and adjustable interior for a casket is provided which is not excessively noisy during installation into and removal from the casket.

These and other objects and advantages of the present invention will become more readily apparent during the following detailed description taken in conjunction with the drawings herein, in which:

DETAILED DESCRIPTION OF THE INVENTION

Figure 1:
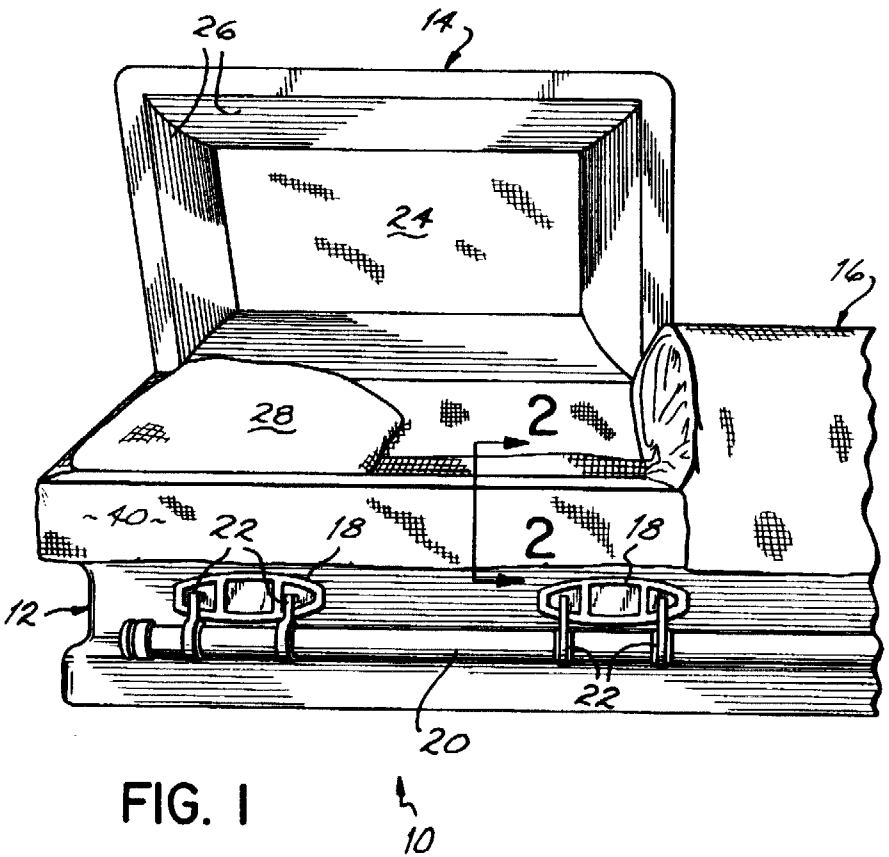
FIG. 1 is a partial side perspective view of a casket and interior according to the present invention.

Referring first to FIG. 1, there is illustrated a casket 10 according to the principles of the present invention. Casket 10 includes a casket shell 12 and a pair of half caps 14, 16 pivotally secured to the shell 12 by means not shown but known to those skilled in the art. Escutcheons 18 are secured to the shell 12 and a handlebar 20 is pivoted to the escutcheons 18 via arms 22. Half cap 14 includes a decorative cap panel 24 and decorative peripheral puffing 26. Pillow 28 is also provided as is conventional.

Figure 2A:
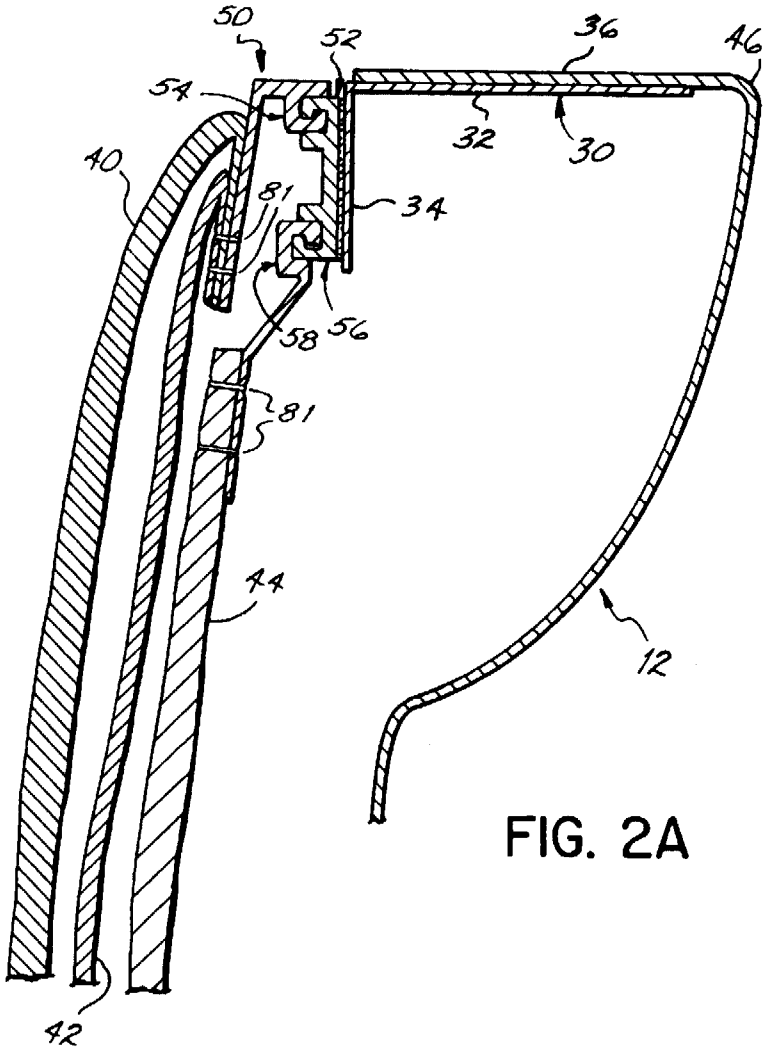
FIG. 2A is a view taken along line 2—2 of FIG. 1 illustrating the placement of the casket interior during periods when the casket cap is closed.
Figure 2B:
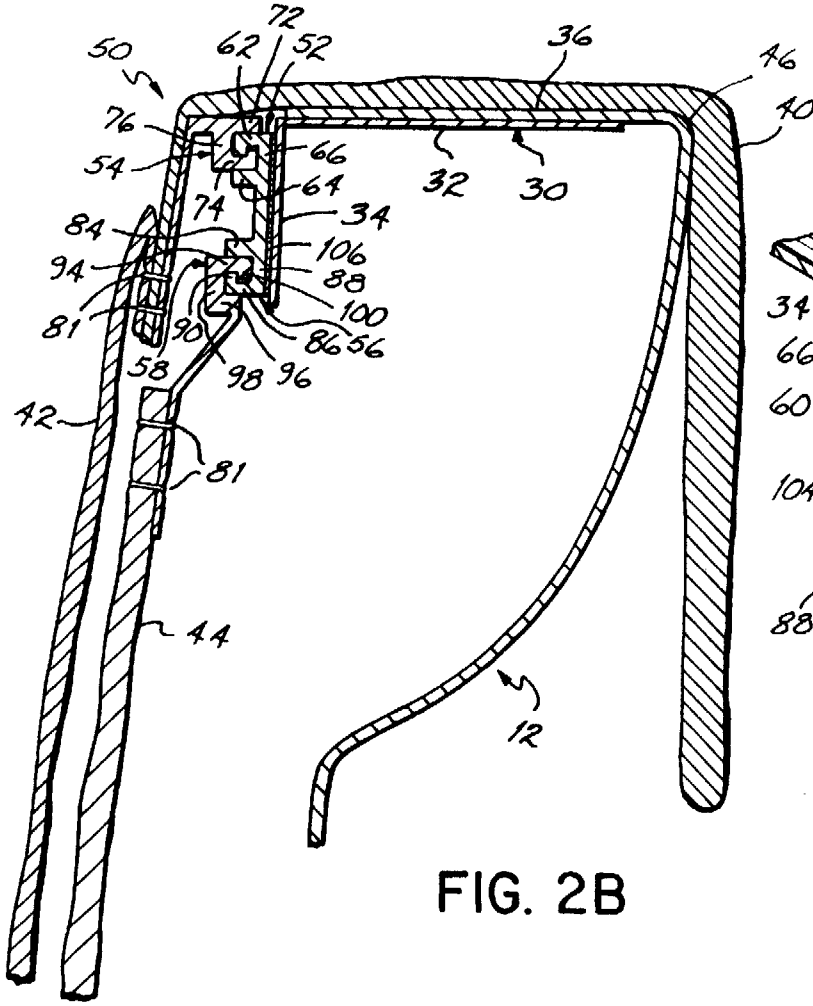
FIG. 2B is a view similar to FIG. 2A but illustrating the placement of the casket interior during periods when the casket cap is open for presentation.

Referring now to FIGS. 2A and 2B, casket shell 12 includes a flange 30 including a horizontal leg 32 and a vertical leg 34 depending from horizontal leg 32. Horizontal leg 32 is secured to horizontal top edge 36 of the shell 12. A big body 40, small body 42 and polyester or other batting or padding 44 are removably attached to the leg 34 of the flange 30 as will be subsequently described. As seen in FIG. 2B, during presentation and viewing of a deceased in the casket 10, head cap 14 is opened and big body 40 is swung out of the casket to lie atop the casket shell top edge 34 and to depend downwardly from the front or forward facing edge 46 thereof.

Figure 3:
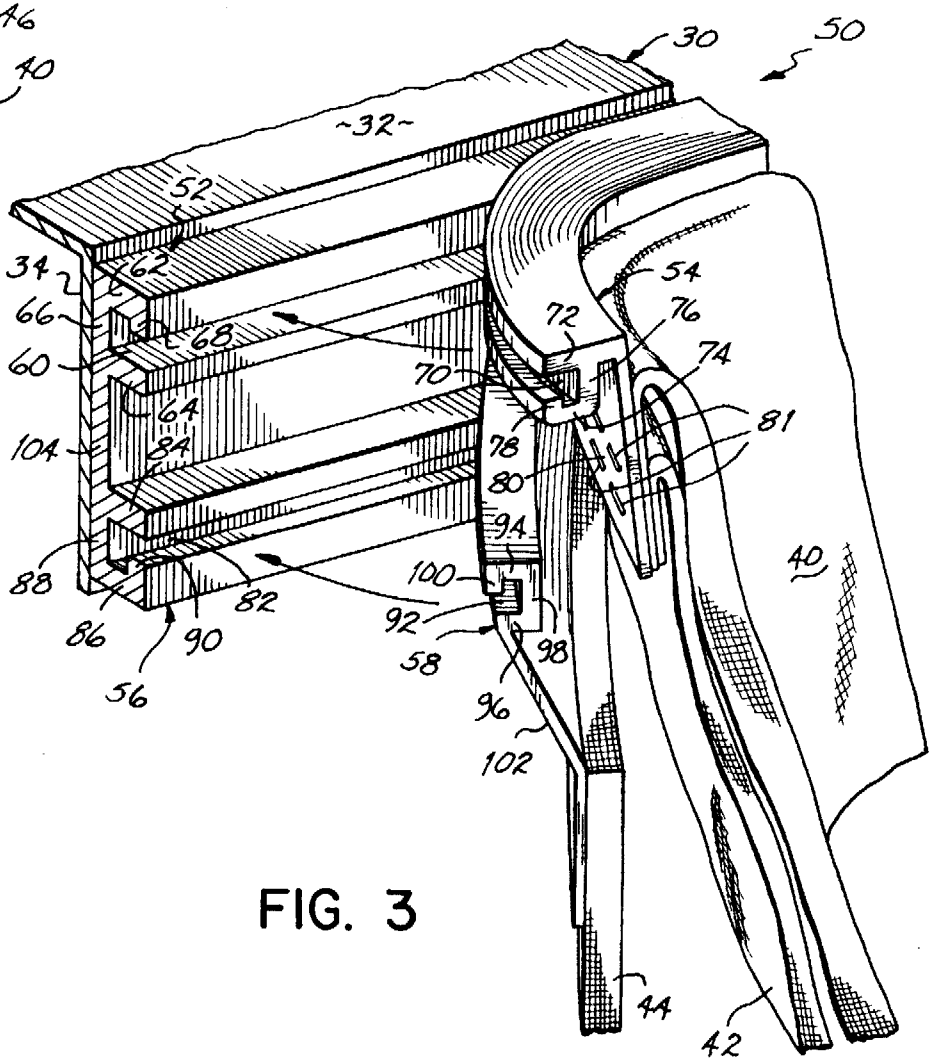
FIG. 3 is a partial perspective view of a portion of the casket shell illustrating installation of the casket interior into the shell.

Referring to FIGS. 2A, 2B, and 3, an elongated fastening device 50 includes at least a first portion 52 and a second portion 54, and in the preferred embodiment illustrated includes a third portion 56 and a fourth portion 58.

First portion 52 comprises a channel 60 including a pair of side walls 62, 64 and a web wall 66 interconnecting the side walls 62, 64. Side Wall 62 includes a lip 68 on a free edge thereof projecting toward the other side wall 64. Second portion 54 similarly includes a channel 70 including a pair of side walls 72, 74 interconnected by a web wall 76. Side wall 74 includes a lip 78 on a free edge thereof which projects toward the other side wall 72. Lips 68 and 78 of first and second fastening portion 52 and 54 respectively thus project toward one another. A panel 80 depends from the second fastening portion 54 and has attached thereto the big body 40 and small body 42, as by stitching at 81. Other means of attaching the big body 40 and small body 42 to panel 80 may be utilized such as thermo bonding.

Third fastening portion 56 is similar to first fastening portion 52 and includes a channel 82 having side walls 84, 86 interconnected by a web wall 88. Side wall 86 includes a lip 90 on a free edge thereof projecting toward side wall 84. Fourth fastening portion 58 is similar to second fastening portion 54 and includes a channel 92 having side walls 94, 96 interconnected by web wall 98. Side wall 94 includes a lip 100 thereon which projects towards side wall 96. Lips 90 and 100 of third and fourth fastening portions 56 and 58 respectively thus project toward one another. The batting or other padding 44 is attached to a panel 102 which depends from fourth fastening portion 58 as by stitching at 81. Other means of attaching the batting 44 to panel 102 may be utilized such as thermo bonding. Second and fourth fastening portions 54 and 58 are separate pieces whereas first and second fastening portions 52 and 56 are actually integral being joined by web 104. A layer of adhesive 106 or other means of securement secures the web walls 56, 88 and 104 and hence the first and third fastening portions 52 and 56 to the depending vertical portion 34 of the flange 30. In the embodiment illustrated, casket 10 and hence shell 12 and flange 30 are metal. It will be appreciated that the present invention can readily be applied to wood caskets as well, in which case first and third fastening portions 52, 56 would be attached to the inside surface of the wooden shell wall as by stapling the web 104 thereto with staples.

The fastening portions 52, 54, 56 and 58 are preferably fabricated of resilient material such as low density polyethylene. A preferred form of the fastening device for the present invention is available from the Maxigrip Division of Illinois Tool Works, Grandview, Ill. as part Nos. SK930113-02 (fastening device 54), SK930113-04 (fastening device 58) and SK930113-3 (fastening devices 52 and 56, one integral piece).

In use, the fastening device 52 and/or fastening devices 52 and 56 are secured to the casket shell wall as by adhesives, staples or other means. The big body 40, small body 42 and batting, padding 44 or other sheet material are secured to the fastening devices 54 and 58, as by sewing, adhesives or other securement means. The padding 44 is first attached to the casket shell interior by attaching the fastening portion 58 to the fastening portion 56. As the fastening portions are fabricated of resilient material, fastening portion 58 may be flexed as shown in FIG. 3 and simply pressed against the fastening portion 56. The resilient channels 82 and 92 including lips 90 and 100 respectively flex to allow the lip 100 to pass lip 90 and to reside between web wall 88 and lip 90 of fastening device 56. Similarly, lip 90 passes lip 100 and resides between lip 100 and web wall 98. The channels 82 and 92 including lips 90 and 100 respectively then spring back into their undeflected state locking the portions 56 and 58 together. Next the particular big body and small body combination 40, 42 is selected and is installed in the casket shell in much the same manner. Again, the fastening portion 54 is flexed as shown in FIG. 3 and the portion 54 is simply pressed against the portion 52. Upon engagement the channels 60 and 70 including lips 68 and 78 flex or deflect and lip 78 comes to reside between lip 68 and web wall 66 of portion 52, whereas lip 68 comes to reside between lip 78 and web wall 76 of portion 54. Once installed, both the big body 40 and small body 42, as well as the batting 44, may be readily adjusted longitudinally, that is along the length of the fastening devices 52, 54, 56, 58, by simply sliding the first and second fastening devices relative to one another longitudinally, and sliding the third and fourth fastening devices longitudinally relative to one another.

Those skilled in the art will readily recognize numerous adaptations and modifications which can be made to the casket having quickly interchangeable and adjustable interior of the present invention which will result in an improved casket and interior, yet all of which will fall within the spirit and scope of the present invention as defined in the following claims. Accordingly, the invention is to be limited only by the scope of the following claims and their equivalents.

What is claimed is:

1. A casket having a quickly interchangeable and adjustable interior comprising:

a casket shell;

an elongated fastening device having first and second portions, said first portion being secured to said casket shell; and decorative fabric secured to said second portion of said fastening device;

one of said first and second fastening device portions including a longitudinally continuous female fastening element, the other of said first and second fastening device portions including a longitudinally continuous male fastening element receivable in said female fastening element, said male and female fastening elements being readily relatively moveable longitudinally when said fastening elements are engaged;

said fastening device being constructed and arranged to thereby provide, without any need for using tools, quick installation and removal of said decorative fabric in said casket shell by engagement and disengagement, respectively of said male and female fastening elements and providing longitudinal adjustment of said decorative fabric relative to said casket shell by moving said fastening elements longitudinally relative one another.

2. The casket of claim 1 wherein said female fastening element is a longitudinally continuous channel and said male fastening element is a longitudinally continuous wall receivable in said channel.

3. The casket of claim 2 wherein:

said longitudinally continuous channel includes a pair of side walls interconnected by a web wall, one side wall of said pair of side walls including a lip on a free edge thereof projecting toward the other side wall of said pair of side walls; and said longitudinally continuous wall includes a lip on a free edge thereof projecting toward said longitudinally continuous channel lip;

said longitudinally continuous wall lip residing between said longitudinally continuous channel web wall and lip when said first and second fastening portions are engaged.

4. The casket of claim 3 wherein said first and second fastening device portions are fabricated from resilient material.

5. The casket of claim 1 wherein both of said first and second fastening portions comprise a longitudinally continuous channel having a pair of side walls interconnected by a web wall and wherein one side wall of said pair of side walls of each of said channels is receivable between said pair of side walls of the other of said channels.

6. The casket of claim 5 wherein one side wall of each of said pairs of side walls includes a lip on a free edge thereof, said lips projecting toward one another, each said lip residing between the other said lip and a respective web wall when said first and second fastening portions are engaged.

7. The casket of claim 6 wherein said first and second fastening device portions are fabricated from resilient material.

8. The casket of claim 1 further including batting secured to said fastening device second portion.

9. A casket having a quickly interchangeable and adjustable interior comprising:

a casket shell;

an elongated fastening device having first and second portions, said first portion being secured to said casket shell; and decorative fabric secured to said second portion of said fastening device;

one of said first and second fastening device portions including a longitudinally continuous female fastening element, the other of said first and second fastening device portions including a longitudinally continuous male fastening element receivable in said female fastening element, said male and female fastening elements being readily relatively slidable longitudinally when said fastening elements are engaged;

said fastening device being constructed and arranged to thereby provide, without any need for using tools, quick installation and removal of said decorative fabric in said casket shell by engagement and disengagement, respectively of said male and female fastening elements, and providing longitudinal adjustment of said decorative fabric relative to said casket shell by sliding said fastening elements longitudinally relative one another.

10. The casket of claim 9 wherein both of said first and second fastening portions comprise a longitudinally continuous channel having a pair of side walls interconnected by a web wall and wherein one side wall of said pair of side walls of each of said channels is receivable between said pair of side walls of the other of said channels.

11. The casket of claim 10 wherein one side wall of each of said pairs of side walls includes a lip on a free edge thereof, said lips projecting toward one another, each said lip residing between the other said lip and a respective web wall when said first and second fastening portions are engaged.

12. The casket of claim 11 wherein said first and second fastening device portions are fabricated from resilient material.

13. The casket of claim 9 further including batting secured to said fastening device second portion.

14. A casket having a quickly interchangeable and adjustable interior comprising:

a casket shell;

an elongated fastening device having first and second portions both fabricated from resilient material, said first portion being secured to said casket shell; and decorative fabric secured to said second portion of said fastening device;

both of said first and second fastening device portions comprising a longitudinally continuous channel having a pair of side walls interconnected by a web wall and wherein one side wall of said pair of side walls of each of said channels is receivable between said pair of side walls of the other of said channels;

one side wall of each of said pairs of side walls including a lip on a free edge thereof, said lips projecting toward one another, each said lip residing between the other said lip and a respective web wall when said first and second fastening device portions are engaged;

said first and second fastening device portions being readily relatively slidable longitudinally when said portions are engaged;

said fastening device being constructed and arranged to thereby provide, without any need for using tools, quick installation and removal of said decorative fabric in said casket shell by deflecting said channels to engage and disengage, respectively said fastening device portions, and providing longitudinal adjustment of said decorative fabric relative to said casket shell by sliding said fastening device portions longitudinally relative one another.

15. The casket of claim 14 further including batting secured to said second fastening device portion.

16. A casket having a quickly interchangeable and adjustable interior comprising:

a casket shell;

an elongated fastening device having first, second, and third portions, said first portion being integrally appended to said third portion and said first and third portions being secured to said casket shell, said first portion including a generally vertically-extending lip, said third portion including a generally vertically-extending lip extending in a direction opposing the lip of said first portion, and said second portion including a generally vertically-extending lip; and decorative fabric secured to said second portion of said fastening device;

said first and third portions each including a longitudinally continuous female fastening element, said second portion including a longitudinally continuous male fastening element receivable in said female fastening element of one of said first and third portions, said lip of said second portion engaging said lip of said one of said first and third portions when said male fastening element is received in said female fastening element and said second portion is engaged with said one of said first and third portions, said male and female fastening elements being readily relatively moveable longitudinally when said fastening elements are engaged;

said fastening device providing quick installation and removal of said decorative fabric in said casket shell by engagement and disengagement, respectively of said male and female fastening elements, and providing longitudinal adjustment of said decorative fabric relative to said casket shell by moving said fastening elements longitudinally relative one another.

17. The casket of claim 16 wherein said female fastening elements are longitudinally continuous channels and said male fastening element is a longitudinally continuous wall receivable in both of said channels.

18. The casket of claim 17 wherein:

each of said longitudinally continuous channels includes a pair of side walls interconnected by a web wall, one side wall of each said pair of side walls including said lip of said one of said first and third portions on a free edge thereof projecting toward the other side wall of said pair of side walls; and said longitudinally continuous wall includes said lip of said second portion on a free edge thereof projecting toward said longitudinally continuous channel lip of said one of said first and third portions;

said longitudinally continuous wall lip residing between said longitudinally continuous channel web wall and lip when said second fastening portion engages said one of said first and third portions.

19. The casket of claim 18 wherein said first, second, and third fastening device portions are fabricated from resilient material.

20. The casket of claim 16 wherein said first, second and third fastening portions each comprise a longitudinally continuous channel having a pair of side walls interconnected by a web wall and wherein one side wall of said pair of side walls of said second fastening device portion is receivable between said pair of side walls of said channels of one of said first and third fastening device portions.

21. The casket of claim 20 wherein one side wall of each of said pairs of side walls includes said corresponding lip on a free edge thereof, said engaging lips projecting toward one another, each said engaging lip residing between the other said engaging lip and a respective web wall when said second fastening portion engages said one of said first and third fastening portions.

22. The casket of claim 21 wherein said first and second fastening device portions are fabricated from resilient material.

23. The casket of claim 16 further including batting secured to said fastening device second portion.

24. A casket having a quickly interchangeable and adjustable interior comprising:

a casket shell;

an elongated fastening device having first, second, third, and fourth portions, said first portion being integrally appended to said third portion and said first and third portions being secured to said casket shell; and decorative fabric secured to said second portion of said fastening device and padding secured to said fourth portion of said fastening device;

said first and third portions each including a longitudinally continuous female fastening element, said second and fourth portions each including a longitudinally continuous male fastening element receivable in said female fastening elements, said male and female fastening elements being readily relatively slidable longitudinally when said fastening elements are engaged;

said fastening device providing quick independent installation and removal of said decorative fabric and said padding in said casket shell by engagement and disengagement, respectively of said corresponding male and female fastening elements, and providing longitudinally adjustment of said decorative fabric and said padding relative to said casket shell and relative to one another by sliding said corresponding fastening elements longitudinally relative one another.

25. The casket of claim 24 wherein said first, second, third, and fourth fastening portions each comprise a longitudinally continuous channel having a pair of side walls interconnected by a web wall and wherein one side wall of said pair of side walls of each of said channels of said second and fourth portions is receivable between said pair of side walls of said channels of said first and third portions.

26. The casket of claim 25 wherein one side wall of each of said pairs of side walls includes a lip on a free edge thereof, said lips of said first and second portions projecting toward one another and said lips of said third and fourth portions projecting toward one another, said lip of said second portion residing between said lip of said first portion and a respective web wall when said first and second fastening portions are engaged.

27. The casket of claim 26 wherein said first and second fastening device portions are fabricated from resilient material.

28. The casket of claim 24 further including batting secured to said fastening device second portion.

29. A casket having a quickly interchangeable and adjustable interior comprising;

a casket shell;

an elongated fastening device having first, second, third, and fourth portions fabricated from resilient material, said first portion being integrally appended to said third portion and said first and third portions being secured to said casket shell; and decorative fabric secured to said second and fourth portions of said fastening device;

said first, second, third, and fourth portions of the fastening device each comprising a longitudinally continuous channel having a pair of side walls interconnected by a web wall, both of said side walls of said first portion being spaced apart from both of said side walls of said third portion, wherein one side wall of said pair of side walls of said second portion is receivable between said pair of side walls of said first portion and one side wall of said pair of side walls of said fourth portion is receivable between said pair of side walls of said third portion;

one side wall of each of said pairs of side walls including a lip on a free edge thereof, said lip of said second portion projecting toward said lip of said first portion and said lip of said fourth portion projecting toward said lip of said third portion, each said lip residing between a corresponding lip and a respective web wall when said first and second fastening device portions are engage and said third and fourth fastening device portions are engaged;

said first and second fastening device portions being readily relative slidable longitudinally when said portions are engaged;

said fastening device providing quick installation and removal of said decorative fabric in said casket shell by deflecting said channels to engage and disengage, respectively said fastening device portions, and providing longitudinal adjustment of said decorative fabric relative to said casket shell by sliding said fastening device portions longitudinally relative one another.

30. The casket of claim 29, wherein said lip of said fourth portion resides between said lip of said third portion and a respective web wall when said third and fourth fastening portions are engaged.

31. The casket of claim 29 wherein said lip of said first portion projects in a direction toward said lip of said third portion and said lip of said third portion projects in a direction toward said lip of said first portion.

32. A casket comprising:

an elongated casket shell including a generally vertically-extending wall, a big body, a small body, padding, and fasteners connecting the big body, the small body, and the padding to the casket shell so that the big body, the small body, and the padding can move longitudinally relative to the shell while connected to the shell, the padding being connected independently of the big body and the small body so that the padding can move longitudinally relative to the shell and relative to the big body and the small body.

33. The casket of claim 32, wherein the positions of the big body, the small body, and the padding are infinitely adjustable in the longitudinal direction relative to the shell.

34. The casket of claim 32, wherein the fastener includes a first portion attached to the wall of the casket shell, a third portion integrally appended to the first portion and attached to the wall of the casket shell, and a second portion attached to the big body and to the small body, the second portion engaging the first portion when the big body and the small body are fastened to the casket shell, and a fourth portion attached to the padding and engaging the third portion when the padding is fastened to the casket shell.

35. The casket of claim 34, wherein the fastener includes a generally plan and generally vertically disposed base mounted to the wall of the casket shell and the first and third portions are upstanding portions projecting away from the base.

36. A casket comprising:

a casket shell including a generally vertically-extending first wall panel cooperating with a generally vertically-extending second wall panel to define an inside of the casket shell therebetween, decorative fabric, and a fastening device securing the decorative fabric to the first wall panel, the fastening device including a first portion attached to the first wall panel and a second portion attached to the fabric, the first portion having a longitudinally-extending and generally inwardly-directed side wall and the second portion having a longitudinally-extending and generally outwardly-directed side wall engaging the inwardly-directed side wall of the first portion.

37. The casket of claim 36, wherein the side wall of the first portion is generally horizontal and the side wall of the second portion is generally horizontal.

38. The casket of claim 37, wherein the side wall of the second portion is carried by the side wall of the first portion to block downward movement of the second portion relative to the first portion.

39. The casket of claim 37, wherein the side wall of the first portion is positioned to lie above the side wall of the second portion to block upward movement of the second portion relative to the first portion.

40. The casket of claim 36, wherein the first portion further includes a lip appended to the side wall of the first portion, the lip extending way from the first portion in a direction away from the side wall of the second portion.

41. The casket of claim 40, wherein the side wall of the second portion is a first side wall and the second portion further includes a second side wall spaced apart from the first side wall and cooperating therewith to define a channel therebetween and the side wall of the first portion is positioned to lie in the channel when the first and second portions are engaged.

42. The casket of claim 41, where the second side wall further includes a lip extending away from the second side wall in a direction toward the side wall of the first portion, the lip of the first portion engaging the lip of the second portion to block outward movement of the second portion relative to the first portion.

43. A method for attaching decorative fabric to the interior of a casket shell including a generally vertical wall having an inner surface, the method comprising the steps of:

providing an elongated fastener having a first portion attached to the inner surface of the casket shell and a second portion attached to the decorative fabric, positioning the second portion vertically adjacent to the first portion and at any desired longitudinal position adjacent to the first portion, and pressing the second portion outwardly against the first portion until the second portion is fastened to the first portion.

* * * * *

UNITED STATES PATENT AND TRADEMARK OFFICE

CERTIFICATE OF CORRECTION

PATENT NO. : 5,784,768

DATED : July 28, 1998

INVENTOR(S) : Ilija Rojdev

It is certified that error appears in the above-indentified patent and that said Letters Patent is hereby corrected as shown below:

Column 2, line 30 "section portions" should read -- second portions --.

Column 9, line 30 "are engage" should read -- are engaged --.

Column 10, line 9 "plan" should read -- planar --.

Column 10, line 40 "way" should read -- away --.

Signed and Sealed this

Twenty-sixth Day of January, 1999

*Attest:*

*Attesting Officer*

*Acting Commissioner of Patents and Trademarks*